US009682747B2

(12) United States Patent
Malla et al.

(10) Patent No.: US 9,682,747 B2
(45) Date of Patent: Jun. 20, 2017

(54) METHODS FOR ASSEMBLING A MODULAR FLOATING PRODUCTION STORAGE AND OFFLOADING VESSEL

(71) Applicant: KELLOGG BROWN & ROOT LLC, Houston, TX (US)

(72) Inventors: Upendra Malla, Houston, TX (US); Krishnamurthy Karri, New Orleans, LA (US)

(73) Assignee: Kellogg Brown & Root LLC, Houston, TX (US)

( * ) Notice: Subject to any disclaimer, the term of this patent is extended or adjusted under 35 U.S.C. 154(b) by 0 days.

(21) Appl. No.: 14/615,298

(22) Filed: Feb. 5, 2015

(65) Prior Publication Data

US 2015/0217836 A1 Aug. 6, 2015

Related U.S. Application Data

(60) Provisional application No. 61/936,701, filed on Feb. 6, 2014.

(51) Int. Cl.

| | |
|---|---|
| ***B63B 21/58*** | (2006.01) |
| ***B65D 88/78*** | (2006.01) |
| ***B63B 3/00*** | (2006.01) |
| ***B63B 3/02*** | (2006.01) |
| ***B63B 3/08*** | (2006.01) |
| ***B63B 9/06*** | (2006.01) |
| *B63B 35/44* | (2006.01) |

(52) U.S. Cl.

CPC ..... *B63B 3/08* (2013.01); *B63B 9/06* (2013.01); *B63B 2035/448* (2013.01); *Y10T 29/49817* (2015.01); *Y10T 29/49959* (2015.01)

(58) Field of Classification Search

CPC ..... B63B 3/08; B63B 9/06; B63B 2035/448; Y10T 29/49817; Y10T 29/49959

USPC ..... 114/77 A, 77 R, 267, 266, 65 R, 249

See application file for complete search history.

(56) References Cited

U.S. PATENT DOCUMENTS

| | | | | |
|---|---|---|---|---|
| 3,036,539 A | | 5/1962 | Storey | |
| 3,878,806 A | | 4/1975 | Garcia | |
| 3,983,830 A | * | 10/1976 | Morgan | B63B 3/08 114/266 |
| 4,321,882 A | * | 3/1982 | Sluys | E02B 3/064 114/266 |
| 5,697,313 A | | 12/1997 | Horn | |

(Continued)

FOREIGN PATENT DOCUMENTS

| | | |
|---|---|---|
| WO | 2007029999 | 3/2007 |

*Primary Examiner* — Anthony Wiest

(74) *Attorney, Agent, or Firm* — Gary Machetta

(57) ABSTRACT

Embodiments described generally relate to methods for assembling a modular floating production storage and offloading (FPSO) vessel. A cargo module section, a forward module, and a rear module can be positioned and aligned with each other such that the cargo module section can be disposed between the forward module and the rear module. A plurality of connectors can be coupled together to secure the forward module and the cargo module section together and another plurality of connectors can be coupled together to secure the rear module and the cargo module section together. A first topside module can be installed onto or over an upper surface of the forward module and can include a flare tower, a turret, hydrocarbon production equipment, or any combination thereof.

10 Claims, 7 Drawing Sheets

(56) References Cited

U.S. PATENT DOCUMENTS

| | | | | |
|---|---|---|---|---|
| 7,314,017 | B2 * | 1/2008 | Moore | B63B 35/34<br>114/263 |
| 7,669,541 | B2 | 3/2010 | Horton | |
| 7,770,531 | B2 | 8/2010 | Hardell | |
| 7,823,524 | B2 * | 11/2010 | Van Cann | E21B 7/124<br>114/356 |
| 8,327,789 | B2 | 12/2012 | Emch | |

* cited by examiner

METHODS FOR ASSEMBLING A MODULAR FLOATING PRODUCTION STORAGE AND OFFLOADING VESSEL

CROSS REFERENCE TO RELATED APPLICATION

This application claims the benefit of U.S. Provisional Application No. 61/936,701, filed on Feb. 6, 2014, the entirety of which is incorporated by reference herein.

BACKGROUND

Field

Embodiments described generally relate to methods for assembling modular floating production storage and offloading vessels.

Description of the Related Art

In the production of offshore oil and gas, floating production storage and offloading (FPSO) vessels are often used to produce and process hydrocarbons and store the resulting products. FPSO vessels are often a more attractive choice than fixed platforms for hydrocarbon production and processing in deep water fields because such floating systems typically require a lower capital investment.

A conventional FPSO vessel is generally designed for a particular job with a set of design requirements relative to the specified production worksite. After the job is complete, the FPSO vessel may sit idle for some time due to its original configuration not being suitable for prospective worksites. The FPSO vessel, therefore, must remain idle until the next job at a worksite that is suitable for the specifically configured FPSO vessel becomes available. Alternately, the conventional FPSO vessel may be reconstructed as required by a future worksite. However, such modifications are generally cost prohibitive, time restrictive, or impractical to complete. Additionally, conventional FPSO vessels may also not be reusable due to damage that can be incurred to the hull or other portions of the FPSO vessel, such as caused by an impact at sea.

There is a need, therefore, for methods for assembling and using FPSO vessels so that the FPSO vessel can be efficiently reconfigured for a variety of different type of worksites.

BRIEF DESCRIPTION OF THE DRAWINGS

So that the manner in which the above recited features can be understood in detail, a more particular description, briefly summarized above, may be had by reference to embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Embodiments herein relate to methods for assembling modular floating production storage and offloading (FPSO) vessels. The method for assembling the modular FPSO vessel can include positioning a cargo module section, a forward module, and a rear module in alignment, where the cargo module section can be disposed between the forward module and the rear module. The modular FPSO vessel can include a plurality of first connectors that can be disposed on a first side of the forward module, a plurality of second connectors that can be disposed on a first side of the rear module, a plurality of third connectors that can be disposed on a first side of the cargo module section, and a plurality of fourth connectors that can be disposed on a second side of the cargo module section, where the first and second sides of the cargo module section can be opposed to one another. The method can include coupling together the plurality of first connectors and the plurality of third connectors to secure together the forward module and the cargo module section together, and coupling together the plurality of second connectors and the plurality of fourth connectors to secure together the rear module and the cargo module section. The method can also include installing a first topside module onto an upper surface of the forward module, where the first topside module can include a flare tower, a turret, hydrocarbon production equipment, or any combination thereof.

Figure 1:
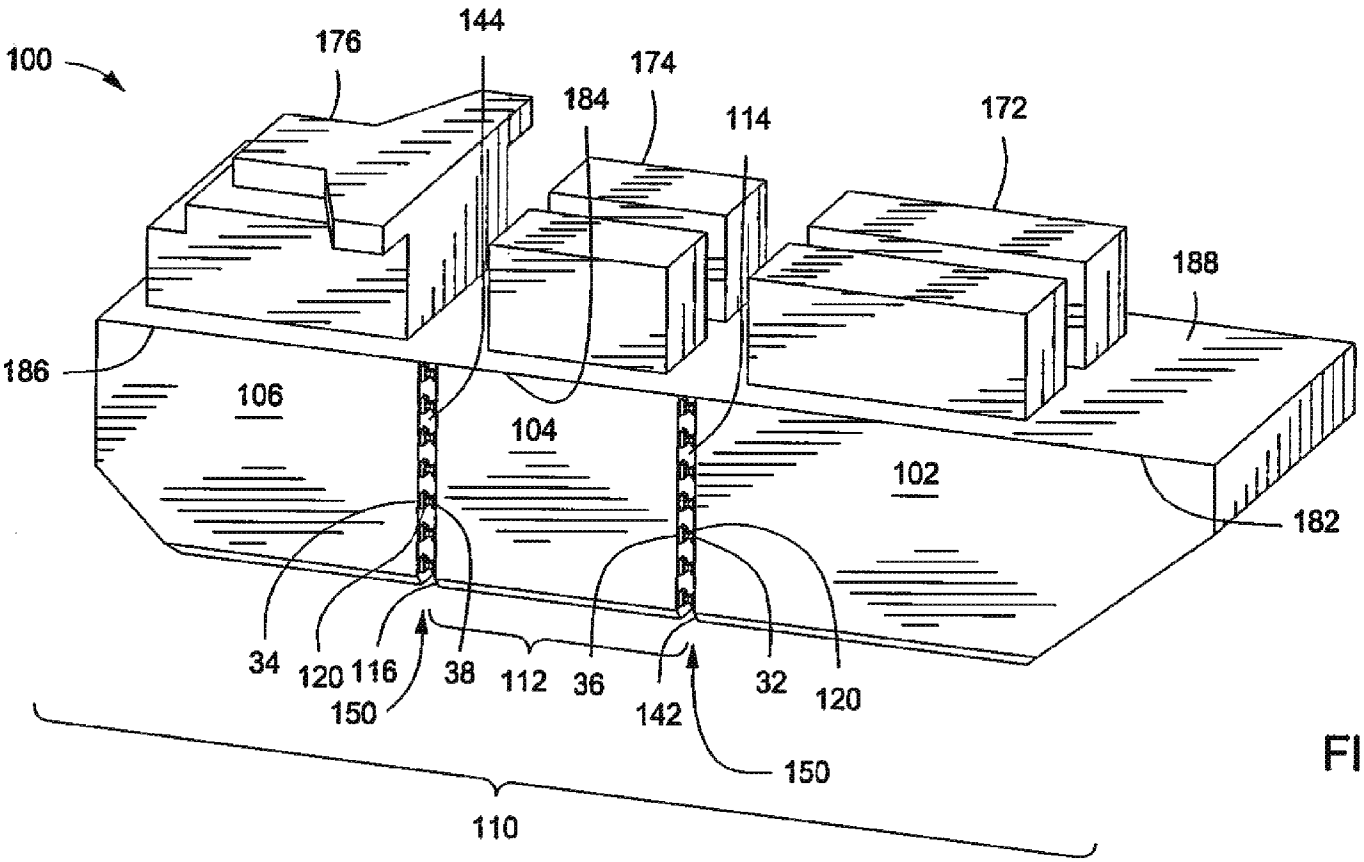
FIG. 1 depicts a perspective view of an illustrative modular floating production storage and offloading vessel, according to one or more embodiments described.

FIG. 1 depicts a perspective view of an illustrative modular FPSO vessel 100, according to one or more embodiments. The modular FPSO vessel 100 can include a forward module 102, one or more cargo modules 104, and a rear module 106 which can be contained in a modular hull 110. The one or more cargo modules 104 can be contained in a cargo module section 112 that can be arranged, positioned, or otherwise disposed between the forward module 102 and the rear module 106. The cargo module section 112 can include a first side 114 and a second side 116 that can be opposed to one another. The first side 114 can be a bow-facing side of the cargo module section 112 and the second side 116 can be a stern-facing side of the cargo module section 112.

Figure 2:
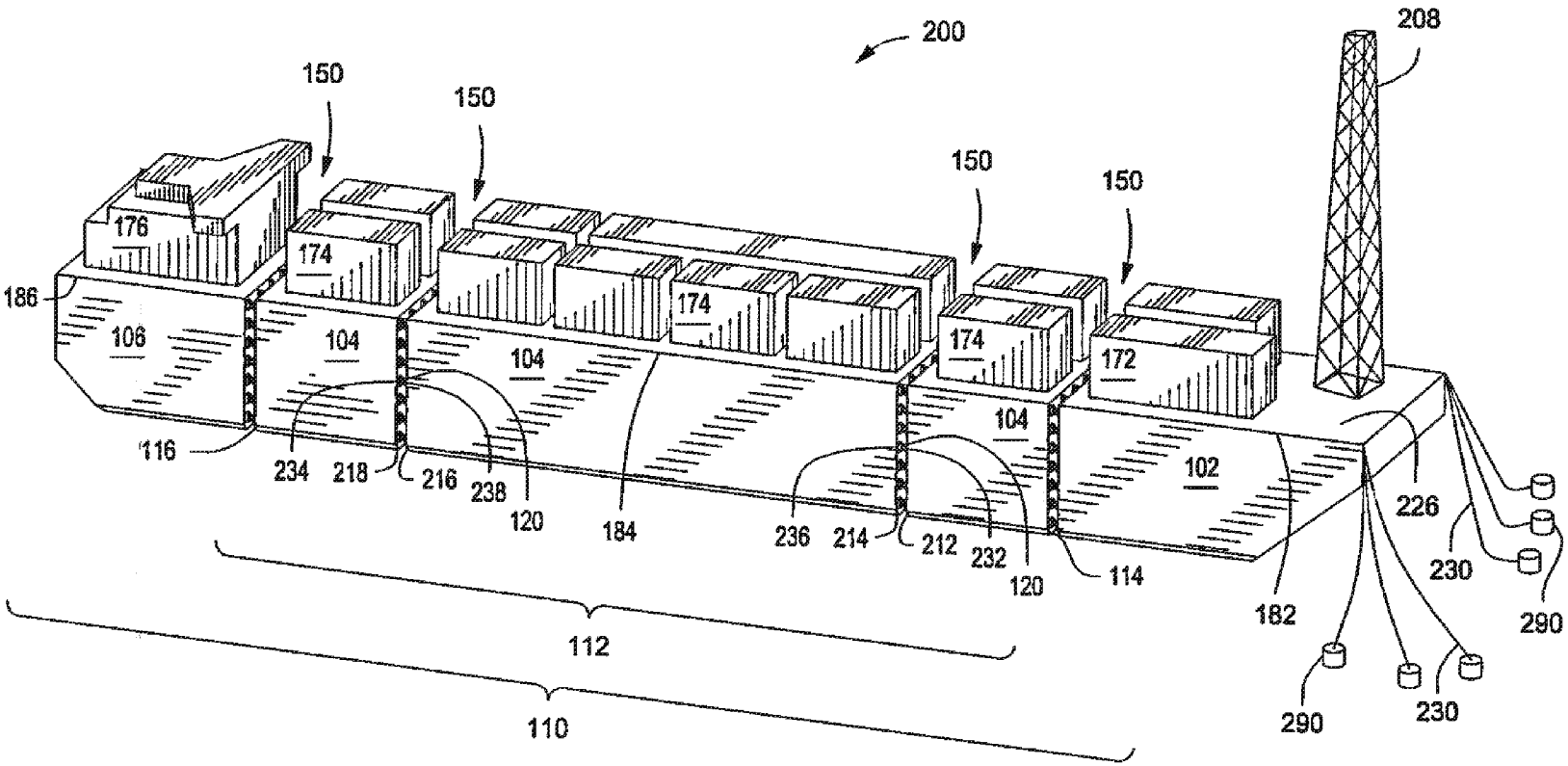
FIG. 2 depicts a perspective view of another illustrative modular floating production storage and offloading vessel, according to one or more embodiments described.

In one embodiment, the cargo module section 112 depicted in FIG. 1 contains a single cargo module 104 that has both the first side 114 and the second side 116. In other embodiments, the cargo module section 112 can be expanded and can have two or more cargo modules 104, as depicted in FIG. 2 and later discussed below. For the cargo module section 112 having two or more cargo modules 104, the first side 114 of the cargo module section 112 can be a bow-facing side of a first cargo module 104 and the second side 116 of the cargo module section 112 can be a stem-facing side of a second cargo module 104. The cargo module section 112 can include one, two, or three cargo modules 104 to four, five, six, seven, eight, nine, ten, eleven, twelve, or more cargo modules 104. In some examples, the cargo module section 112 can include two to about twelve, two to about ten, two to eight, two to six, two to four, three to about twelve, three to about ten, three to eight, three to six, or three to four cargo modules 104.

In some embodiments, one or more of the cargo modules 104 can store or otherwise contain liquids, gases, fluids, or solids, for example, but not limited to, processed or unprocessed oils or petroleum substances, natural gas or other gases, water or aqueous solutions, or other products or materials. The storage capacity of the cargo module section 112 can be increased or decreased by adding or removing one or more cargo modules 104 and/or exchanging cargo modules 104 of varying storage capacities. In some examples, the storage capacity of the cargo module section 112 and/or the storage capacity of the total amount of cargo modules 104 can be about 100,000, about 200,000, or about 500,000 barrels to about 700,000, about 1,000,000, about 1,600,000, about 2,000,000, about 3,000,000, about 4,000,000, or about 5,000,000 barrels. For example, the storage capacity of the cargo module section 112 and/or the storage capacity of the total amount of cargo modules 104 can be about 100,000 barrels to about 5,000,000 barrels, about 200,000 barrels to about 4,000,000 barrels, about 300,000 barrels to about 3,000,000 barrels, about 400,000 barrels to about 2,000,000 barrels, about 500,000 barrels to about 2,000,000 barrels, or about 550,000 barrels to about 2,000,000 barrels, about 500,000 barrels to about 1,600,000 barrels, or about 550,000 barrels to about 1,600,000 barrels.

Referring again to FIG. 1, a plurality of coupled connector units 150 can be disposed on and between a first side 142 of the forward module 102 and the first side 114 of the cargo module section 112. The first side 142 of the forward module 102 can be fastened, secured, coupled, or otherwise connected to the first side 114 of the cargo module section 112. For example, a plurality of the first connectors 32 can be disposed on the first side 142 of the forward module 102, and a plurality of the third connectors 36 can be disposed on the first side 114 of the cargo module section 112 to connect together the forward module 102 and the cargo module section 112. The plurality of the first connectors 32 and the plurality of the third connectors 36 can be coupled together with a plurality of locking pins 120 to form the plurality of coupled connector units 150 to secure the forward module 102 and the cargo module section 112 together. Each of the coupled connector units 150 disposed between the forward module 102 and the cargo module section 112 can include at least one of the first connectors 32, one of the third connectors 36, and one of the locking pins 120.

Similar to the plurality of coupled connector units 150 disposed between the forward module 102 and the cargo module section 112, another plurality of coupled connector units 150 can be disposed on and between a first side 144 of the rear module 106 and the second side 116 of the cargo module section 112. The first side 144 of the rear module 106 can be fastened, secured, coupled, or otherwise connected to the second side 116 of the cargo module section 112. For example, a plurality of the second connectors 34 can be disposed on the first side 144 of the rear module 106, and a plurality of the fourth connectors 38 can be disposed on the second side 116 of the cargo module section 112 to connect together the rear module 106 and the cargo module section 112. The plurality of second connectors 34 and the plurality of fourth connectors 38 can be coupled together with another plurality of locking pins 120 to form another plurality of coupled connector units 150 to secure the rear module 106 and the cargo module section 112 together. Each of the coupled connector units 150 disposed between the rear module 106 and the cargo module section 112 can at least include one of the second connectors 34, one of the fourth connectors 38, and one of the locking pins 120.

The forward module 102, the rear module 106, and/or one or more cargo modules 104 can independently be moved, positioned, and/or held in place when being added to or removed from the modular FPSO vessel 100 by the use of one or more cranes, winches, tug boats, drydocks, or any combination thereof. For example, one or more cargo modules 104 can be added to or removed from the cargo module section 112 or can be added or removed from between the forward module 102 and the rear module 106 by the use of one or more winches or tug boats.

Referring again to FIG. 1, one or more of topside modules 172, 174, and 176 can be disposed on or over the modular hull 110. For example, one or more topside modules 172 can be installed or otherwise disposed on or over an upper side 182 of the forward module 102, one or more topside modules 174 can be installed or otherwise disposed on or over an upper side 184 of the cargo module section 112, and one or more topside modules 176 can be installed or otherwise disposed on or over an upper side 186 of the rear module 106. Illustrative topside modules 172 can be or include, but are not limited to, one or more of flare towers, turrets, hydrocarbon production equipment or tools, separation equipment, gas compression equipment, or any combination thereof. In some examples, the topside modules 172 can be or include the hydrocarbon production equipment and crude oil can be separated in the hydrocarbon production equipment to produce one or more gaseous hydrocarbon products, one or more liquid hydrocarbon products, one or more aqueous products, or any combination thereof. Illustrative topside modules 174 can be or include, but are not limited to, one or more of hydrocarbon processing equipment or tools, hydrocarbon storage tanks, offloading equipment and systems, or a combination thereof. The hydrocarbon processing equipment can include power generation sources, water treatment equipment, separation and gas processing equipment, compressors, and other equipment, which can be included in the modular FPSO vessel 100. Illustrative topside modules 176 can be or include, but are not limited to, one or more of a helipad, accommodations, living quarters, galley and mess areas, control room and control room equipment, observation bridge, or wheelhouse. In other embodiments, any one or more of the topside modules 172, 174, and 176 can be disposed on or over any of the upper sides 182, 184, and 186.

In some configurations, the forward module 102 can include the production tool, hydrocarbon production equipment (e.g., hydraulic, pneumatic or electrical equipment), hydrocarbon processing equipment (e.g., heaters, scrubbers, separators, or gas treatment systems), engine equipment (e.g., generators or valves), fuel system (e.g., heaters, valves, supply pumps, or tanks), propulsion system (e.g., engine or motor), and/or other similar devices. The forward module 102 can also remain unused or empty. In some embodiments, the topside modules 176 can include a variety of hydrocarbon production equipment, hydrocarbon processing equipment, or other equipment. The hydrocarbon processing equipment can include power generation sources, water treatment equipment, separation and gas processing equipment, compressors, and other equipment, which can be included in the modular FPSO vessel 100. The topside module 172 can include a flare tower, a turret, hydrocarbon production equipment, or any combination thereof. The topside module 174 can include hydrocarbon processing equipment, a storage tank, or any combination thereof.

In some embodiments, the upper surfaces 182 and 184 can be adjacent to each other and can form a continuous upper surface across the modular hull 110. Similarly, the upper surfaces 184 and 186 can be adjacent to each other and can form a continuous upper surface across the modular hull 110. In other embodiments, the upper side 184 can be between and adjacent to both of the upper surfaces 182 and 186 and can form a continuous upper surface across the modular hull 110. In one or more embodiments, a process deck 188 can be disposed on or over at least a portion of any of the upper surfaces 182, 184, and/or 186. For example, the process deck 188 can be disposed on or over at least a portion of the upper surface 182, the upper surface 184, and/or the upper surface 186. In some examples, the process deck 188 can be substantially or completely disposed on or over the upper surface 182, the upper surface 184, and/or the upper surface 186. The process deck 188 can extend over two or more of the forward module 102, the cargo modules 104, and/or the rear module 106. As such the process deck 188 can bridge or cover the spacing disposed therebetween the modules that includes the coupled connector units 150. In some embodiments, any of the topside modules 172, 174, and/or 176 can be installed or otherwise disposed on or over the process deck 188 that in turn can be disposed on or over any of the upper sides 182, 184, and 186.

In another embodiment, the cargo module section 112, the forward module 102, and the rear module 106 can be positioned and aligned for assembling the modular FPSO vessel 100. For example, the cargo module section 112 can be disposed between the forward module 102 and the rear module 106. The plurality of first connectors 32 can be disposed on the first side 142 of the forward module 102, the plurality of second connectors 34 can be disposed on the first side 144 of the rear module 106, the plurality of third connectors 36 can be disposed on the first side 114 of the cargo module section 112, and the plurality of fourth connectors 38 can be disposed on the second side 116 of the cargo module section 112. The first and second sides 114, 116 of the cargo module section 112 can be opposed to one another. The plurality of first connectors 32 and the plurality of third connectors 36 can be coupled together to secure or connect the forward module 102 and the cargo module section 112 together. Also, the plurality of second connectors 34 and the plurality of fourth connectors 38 can be coupled together to secure or connect the rear module 106 and the cargo module section 112 together. One or more first topside modules 172 can be installed on or over the upper side 182 of the forward module 102. The first topside modules 172 can be or include a flare tower, a turret, hydrocarbon production equipment, or any combination thereof The plurality of the first connectors 32 and the plurality of the third connectors 36 can be coupled together by a plurality of the locking pins 120 to form a plurality of coupled connector units 150. Each of the coupled connector units 150 can have at least one of the first connectors 32, one of the third connectors 36, and one of the locking pins 120. Similarly, the plurality of the second connectors 34 and the plurality of the fourth connectors 38 can be coupled together by another plurality of the locking pins 120 to form another plurality of coupled connector units 150. Each of the coupled connector units 150 can have at least one of the second connectors 34, one of the fourth connectors 38, and one of the locking pins 120.

The plurality of coupled connector units 150 can have two or more groups of coupled connector units 150 that can face or otherwise be disposed in different directions relative to each other. For example, a first group of the coupled connector units 150 can be disposed facing in a first direction and a second group of the coupled connector units 150 can be disposed facing in a second direction different than the first direction. In some examples, the first direction can be horizontal and the second direction can be any direction other than horizontal, such as vertical. In other examples, the first direction can be vertical and the second direction can be any direction other than vertical, such as horizontal.

In some embodiments, a location in the cargo module section 112 of the modular FPSO vessel 100 can be identified to receive an additional cargo module (not shown) and the plurality of first connectors 32 and the plurality of third connectors 36 can be uncoupled to provide the location for the additional cargo module. The additional cargo module can have a first side opposed to a second side and can include a plurality of fifth connectors disposed the first side and a plurality of sixth connectors disposed on the second side. Although not illustrated in FIG. 1, the additional cargo module can be positioned between the forward module 102 and the cargo module section 112. The plurality of first connectors 32 and the plurality of fifth connectors disposed on the first side of the additional cargo module can be coupled together to secure the forward module 102 and the additional cargo module together. Also, the plurality of third connectors 36 and the plurality of sixth connectors disposed on the second side of the additional cargo module can be coupled together to secure the cargo module section 112 and the additional cargo module together.

In other embodiments, another location in the cargo module section 112 of the modular FPSO vessel 100 can be identified to receive the additional cargo module (not shown) and the plurality of second connectors 34 and the plurality of fourth connectors 38 can be uncoupled to provide the location for the additional cargo module. Although not illustrated in FIG. 1, the additional cargo module can be positioned between the rear module 106 and the cargo module section 112. The plurality of second connectors 34 and the plurality of fifth connectors disposed on the first side of the additional cargo module can be coupled together to secure the rear module 106 and the additional cargo module together. Also, the plurality of fourth connectors 38 and the plurality of sixth connectors disposed on the second side of the additional cargo module can be coupled together to secure the cargo module section 112 and the additional cargo module together.

FIG. 2 depicts a perspective view of another illustrative modular FPSO vessel 200, according to one or more embodiments. In one embodiment, the modular FPSO vessel 200 can include the cargo module section 112 disposed between the forward module 102 and the rear module 106, as described for the modular FPSO vessel 100. Each of the forward module 102 and the rear module 106 in the modular FPSO vessel 200 can be connected or otherwise coupled to the cargo module section 112 through a plurality of coupled connector units 150. The modular FPSO vessel 200 or portions thereof depicted in FIG. 2 and the modular FPSO vessel 100 or portions thereof depicted FIG. 1 share many common components. It should be noted that like numerals shown in the Figures and discussed herein represent like components throughout the multiple embodiments disclosed herein. It should also be noted that like components shown in the Figures and discussed herein may be labeled in on Figure and not labeled another Figure, as such, both components still represent like components throughout the multiple embodiments disclosed herein.

The cargo module section 112 of the modular FPSO vessel 200, as depicted in FIG. 2, can include three cargo modules 104 coupled together through a plurality of coupled connector units 150 and disposed between the first side 114 and second side 116 of the cargo module section 112. In one embodiment, the first side 114 of the cargo module section 112 can be the bow-facing side of a first cargo module 104 and the second side 114 of the cargo module section 112 can be the stem-facing side of a second cargo module 104.

A plurality of coupled connector units 150 can be disposed on and between a first side 212 of the first cargo module 104 and a first side 214 of a third or additional cargo module 104. Another plurality of coupled connector units 150 can also be disposed and disposed on and between a first side 218 of the second cargo module 104 and a second side 216 of the third or additional cargo module 104. The first side 212 of the first cargo module 104 can be fastened, secured, coupled, or otherwise connected to the first side 214 of the additional cargo module 104. For example, to connect the first and additional cargo modules 104 together, a plurality of the first connectors 232 can be disposed on the first side 212 of the first cargo module 104 and a plurality of the third connectors 236 can be disposed on the first side 214 of the additional cargo module 104. The plurality of the first connectors 232 and the plurality of the third connectors 236 can be coupled together with a plurality of locking pins 120 to form the plurality of coupled connector units 150 to secure the first cargo module 104 and the additional cargo module 104 together. Each of the coupled connector units 150 disposed between the first and additional cargo modules 104 can include at least one of the first connectors 232, one of the third connectors 236, and one of the locking pins 120.

Referring to FIG. 2, the first side 218 of the second cargo module 104 can be fastened, secured, coupled, or otherwise connected to the second side 216 of the additional cargo module 104. For example, a plurality of the second connectors 234 can be disposed on the first side 218 of the second cargo module 104 and a plurality of the fourth connectors 238 can be disposed on the second side 216 of the additional cargo module 104 to connect the second cargo module 104 to the additional cargo module 104. The plurality of second connectors 234 and the plurality of fourth connectors 238 can be coupled together with another plurality of locking pins 120 to form another plurality of coupled connector units 150 to secure the second and additional cargo modules 104 together. Each of the coupled connector units 150 disposed between the second and additional cargo modules 104 can at least include one of the second connectors 234, one of the fourth connectors 238, and one of the locking pins 120.

The modular FPSO vessel 200 can include at least a turret 208 and at least one of the topside modules 172 can be or include one or more flare towers and/or hydrocarbon production equipment. The modular FPSO vessel 200 can also include a process deck 226 disposed on the modular hull 110. The process deck 226 can include hydrocarbon processing equipment, a production tool, offloading systems, living quarters, and/or other similar devices. Illustrative hydrocarbon processing equipment, can include, but is not limited to, separation equipment, gas compression equipment, or a combination thereof. The forward module 102, the cargo modules 104, and the rear modules 206 can be fitted with one or more topside modules 172, one or more topside modules 174, and one or more topside modules 176, respectively. Any of the topside modules 172, 174, and/or 176 can be installed on or over the process deck 226 of the modular FPSO vessel 200.

The process deck 226 of the modular FPSO vessel 200 can be connected to the modular hull 110, which can include the forward module 102, the cargo module section 112, and the rear module 106, through installation of structural supports. The installation of the process deck 226 can be completed on dry land or on the open sea. The modular FPSO vessel 200 can be commissioned immediately for a first job, or the modular FPSO vessel 200 can be kept at a job site or other location for storage. Upon completion of construction of the modular FPSO vessel 200, the modular FPSO vessel 200 can be stored for later use or towed back to the job site for commissioning.

In some embodiments, the cargo module section 112 or one or more cargo modules 104 can be positioned, placed, or otherwise disposed between the forward module 102 and the rear module 106 to assemble the modular FPSO vessel 200. Alternatively, in other embodiments, the forward module 102 and/or the rear module 106 can be positioned, placed, or otherwise disposed to the outside of the cargo module section 112 that contains one or more cargo modules 104. Regardless of the assembly order, the connectors disposed between the adjoining components of the cargo module section 112 can be coupled together to form the plurality of coupled connector units 150.

In one aspect, while in a body of water (e.g. offshore), one or more cargo modules 104, together or separately, can be floated between the forward module 102 and the rear module 106. Alternatively, the forward module 102 and/or the rear module 106 can be floated to the cargo module section 112 or the one or more cargo modules 104 while in a body of water. In another aspect, while on land or in a drydock, one or more cargo modules 104, together or separately, can be moved or otherwise disposed between the forward module 102 and the rear module 106. Alternatively, the forward module 102 and/or the rear module 106 can be moved to the cargo module section 112 or the one or more cargo modules 104 while on land or in a drydock.

Referring again to FIG. 2, the topside module 172 can be installed on or over the upper side 182 of the forward module 102. The topside module 172 can be or include a flare tower, the turret 208, hydrocarbon production equipment, or any combination thereof. The topside module 174 can also be installed on an upper side of at least one of the cargo modules 104. The topside module 174 can include hydrocarbon processing equipment, a hydrocarbon storage tank, or a combination thereof. The turret 208 with one or more mooring lines 230 can be anchored or otherwise secured so that the turret 208 can be in fluid communication with a hydrocarbon well head 290 located on a sea floor. Thereafter, one or more crude oils, gases, or fluids can be processed into one or more gaseous hydrocarbon products, one or more liquid hydrocarbon products, one or more aqueous products, or any combination thereof. One or more compressed hydrocarbon or other products can be stored in the hydrocarbon storage tanks. During processing, impurities can be removed from the gaseous hydrocarbon products to produce further refined products.

The first side 144 of the rear module 106 can be fastened, coupled, or otherwise connected to the cargo module section 112 on the second side 116 of the cargo module section 112. The rear module 106 can include the production tool, hydrocarbon production equipment (e.g., hydraulic, pneumatic, or electrical equipment), hydrocarbon processing equipment (e.g., heaters, scrubbers, separators, or gas treatment systems), engine equipment (e.g., generators or valves), fuel system (e.g., heaters, valves, supply pumps, or tanks), propulsion system (e.g., engine or motor), and/or other similar devices. The rear module 106 can also remain unused or empty, such that the rear module 106 contains no equipment. The production tool can be the turret 208, hydraulic equipment (e.g., pumps, hydraulic motors, or valves), pneumatic equipment (e.g., gas compressors, pneumatic motors, or vacuum pumps), and/or other similar devices.

The amount of cargo modules 104 contained within the cargo module section 112 can be increased or decreased as desired. In some examples, one or more additional cargo modules 104 can be positioned or otherwise disposed between the forward module 102 and the cargo module section 112 while floating in a body of water or contained on land. In other examples, one or more additional cargo modules 104 can be positioned or otherwise disposed between the rear module 106 and the cargo module section 112 while floating in a body of water or contained on land. In other examples, one or more additional cargo modules 104 can be positioned or otherwise disposed between at least two other cargo modules 104 (e.g., a first and a second cargo modules 104) while floating in a body of water or contained on land. Alternatively, one or more cargo modules 104 can be separated or otherwise removed from the cargo module section 112 while floating in a body of water or contained on land.

In other embodiments, a location between the first cargo module 104 and the second cargo module 104 in the cargo module section 112 of the modular FPSO vessel 200 can be identified to receive an additional cargo module 104. The first cargo module 104 can include a plurality of first connectors 232 disposed on a first side 212 of the first cargo module 104 and the second cargo module 104 can include a plurality of second connectors 234 disposed on a first side 218 of the second cargo module 104. The plurality of first connectors 232 on the first cargo module 104 and the plurality of second connectors 234 on the second cargo module 104 can be coupled together, as depicted in FIG. 2.

Although not shown, the plurality of first connectors 232 and the plurality of second connectors 234 can be uncoupled and the first cargo module 104 and the second cargo module 104 can be separated from each other. Thereafter, a third or additional cargo module 104 can be positioned between the first cargo module 104 and the second cargo module 104 and the plurality of first connectors 232 and a plurality of third connectors 236 disposed on a first side 214 of the additional cargo module 104 can be coupled together to secure the first cargo module 104 and the additional cargo module 104 together. Also, the plurality of second connectors 234 and a plurality of fourth connectors 238 disposed on a second side 216 of the additional cargo module 104 can be coupled together to secure the second cargo module 104 and the additional cargo module 104 together. In one example, the third sides 214 and the fourth side 216 can be opposed to one another and on the same cargo module 214. In other examples, not shown, the third sides 214 and the fourth side 216 can be on different cargo modules 214.

Figure 3:
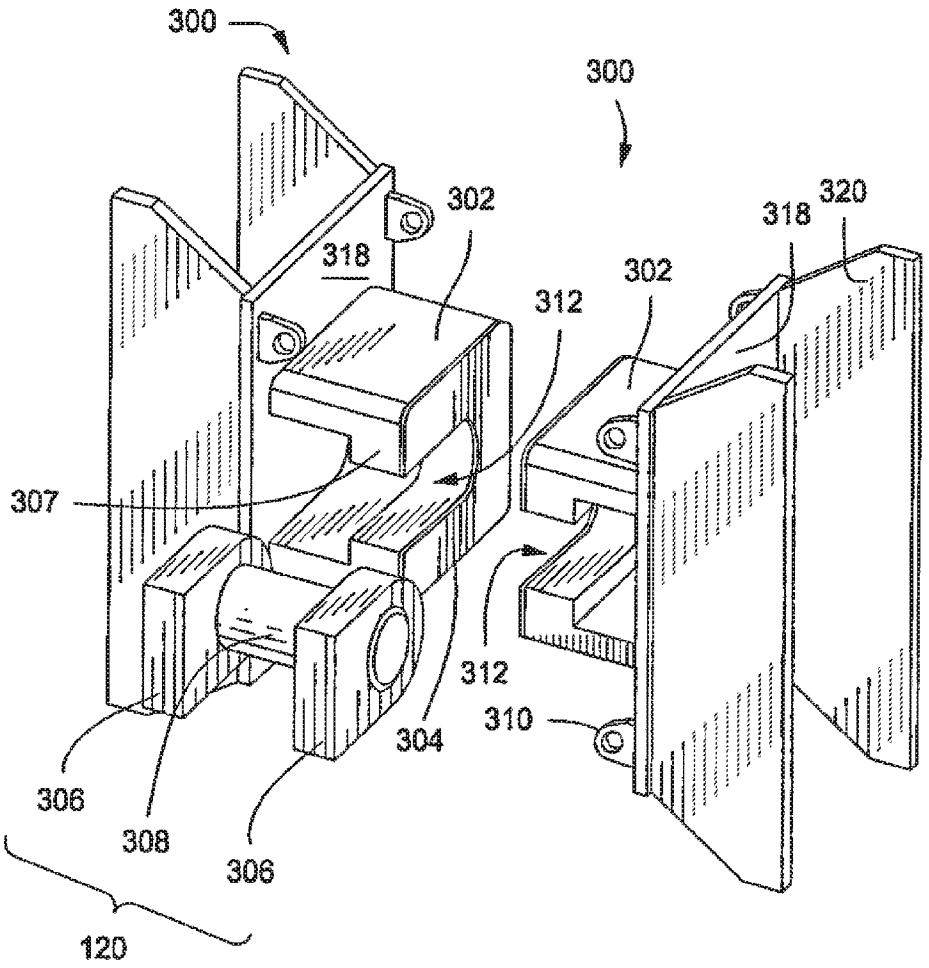
FIG. 3 depicts a perspective view of two connectors and a locking pin, according to one or more embodiments described.

FIG. 3 depicts a perspective view of two illustrative connectors 300 and a locking pin 120, according to one or more embodiments. Each of the connectors 300 can include a locking head 302 having a slot 312 or other opening that inwardly extends from a front surface 307 of the locking head 302. Each locking head 302 can be disposed on a base surface 318 and two or more base wings 320. The base surfaces 318 can be disposed between two or more base wings 320 that can be connected or disposed on one or more surfaces or sides on one or more forward modules, rear modules, cargo modules, and/or cargo module sections. On the opposite side of the locking head 302 as the base surface 318, a damper 304 can be disposed on each locking head 302. One or more alignment padeyes 310 can be disposed on the base surface 318. In one example, as depicted in FIG. 3, each connector 300 can have four total alignment padeyes 310 and one alignment padeye 310 can be disposed on each corner of the base surface 318. The locking pin 120 can include a pin 308 disposed between a pair of locking slides 306.

The two connectors 300 can be aligned and adjoined via locking heads 302. The two dampers 304, one on each of the connectors 300, can be disposed between the two locking heads 302 and can form a buffering a seal therebetween. The dampers 304 can fill any remaining space that otherwise can be between the locking heads 302 once the two connectors 300 are coupled together. The locking pin 120 can be disposed into the slots 312 of the two adjoining connectors 300 to form a coupled connector unit, such as the coupled connector units 150 discussed above and the coupled connector units 350 and 450, depicted in FIGS. 4 and 5 and further discussed below.

The connectors 300 can be any of the connectors 32, 34, 36, and 38 (FIG. 1), any of the connectors 232, 234, 236, and 238 (FIG. 2), or any other connectors that can be disposed on one or more surfaces or sides of the forward module 102, the rear module 106, the cargo modules 104, and/or the cargo module section 112. For example, the connectors 300 can be the first connectors 32 disposed on the first side 142 of the forward module 102, the second connectors 34 disposed the first side 144 of the rear module 106, the third connectors 36 disposed on the first side 114 of the cargo module section 112, and the fourth connectors 38 disposed on the second side 116 of the cargo module section 112, as depicted in FIG. 1. In another example, the connectors 300 can be the first connectors 232 disposed on the first side 242 of the cargo module 104, the second connectors 234 disposed the first side 244 of the cargo module 104, the third connectors 236 disposed on the first side 214 of the cargo module 104, and the fourth connectors 238 disposed on the second side 216 of the cargo module 104, as depicted in FIG. 2.

The various components of the connectors 300, such as the locking head 302, the alignment padeyes 310, the base surface 318, and/or the base wings 320, can independently include or be made of one or more metals, such as, but not limited to, carbon steel, marine steel, hull steel, shipbuilding steel, hardened steel, stainless steel, iron, nickel, chromium, titanium, aluminum, alloys thereof, or any combination thereof. In some specific examples, the locking head 302, the alignment padeyes 310, the base surface 318, and/or the base wings 320 can independently include or be made of one or more of carbon steel, marine steel, hull steel, or shipbuilding steel, such as AH 36 steel. The damper 304 can include one or more materials, such as, but not limited to, natural rubber, synthetic rubber, polymeric or oligomeric resins or plastics, metals (e.g., copper, brass, bronze, zinc, lead, or alloys thereof). In some specific examples, the damper 304 can include natural or synthetic rubber. The pin 308 and the locking slides 306 of the locking pin 120 can independently include or be made of one or more metals, such as, but not limited to, carbon steel, marine steel, hull steel, shipbuilding steel, hardened steel, stainless steel, iron, nickel, chromium, titanium, aluminum, alloys thereof, or any combination thereof.

The diameter of the pin 308 can be about 50 mm, about 100 mm, about 150 mm, or about 200 mm to about 350 mm, about 400 mm, about 500 mm, or about 600 mm. For example, the diameter of the pin 308 can be about 50 mm to about 600 mm, about 100 mm to about 500 mm, about 200 mm to about 400 mm, about 250 mm to about 350 mm, about 270 mm to about 330 mm, or about 290 mm to about 310 mm. The length of the pin 308 and/or the length of locking pin 120 can independently be about 200 mm, about 300 mm, about 400 mm, or about 500 mm to about 800 mm, about 900 mm, about 1,000 mm, or about 1,200 mm. For example, the length of the pin 308 and/or the length of the locking pin 120 can independently be about 200 mm to about 1,200 mm, about 300 mm to about 1,000 mm, about 500 mm to about 1,000 mm, about 600 mm to about 900 mm, about 700 mm to about 800 mm, about 720 mm to about 780 mm, or about 740 mm to about 760 mm.

Figure 4:
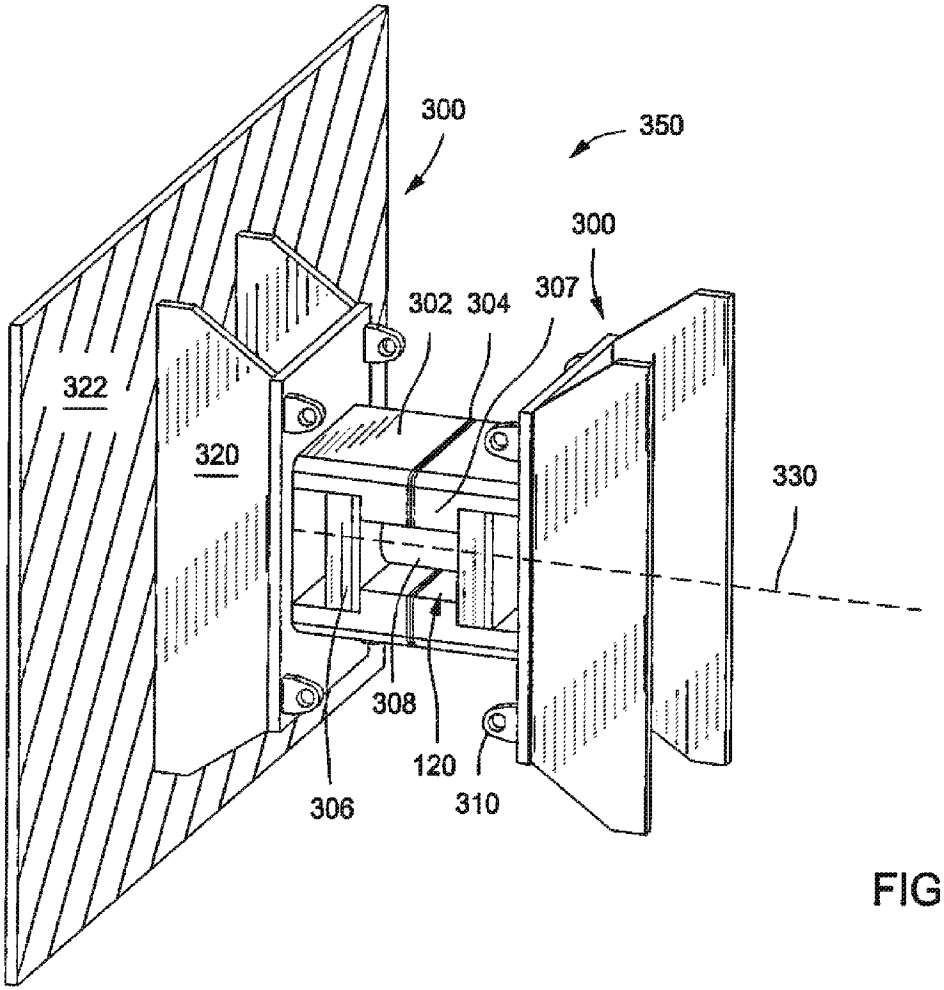
FIG. 4 depicts a perspective view of an illustrative coupled connector unit disposed in a horizontal position, according to one or more embodiments described.

FIG. 4 depicts a perspective view of an illustrative coupled connector unit 350 disposed in a horizontal position, according to one or more embodiments. The coupled connector unit 350 can include two connectors 300 horizontally positioned and coupled together via the locking pin 120. Each of the connectors 300 can be oriented horizontal or substantially horizontal relative to a centralized axis 330 extending lengthwise through the center of the pin 308 contained in the coupled connector unit 350. The front surface 307 of the locking head 302 and the opening to the slot 312 can be facing horizontal or substantially horizontal relative to the centralized axis 330. The base wings 320 can be affixed or otherwise attached to a connecting surface 322 to secure the connectors 300 in the horizontal position.

Once the two connectors 300 are coupled together via the locking pin 120, the dampers 304 can form a seal to further increase the stability of each pair of locking heads 302 during movement of the modular FPSO vessel (e.g., when the modular FPSO vessel is at sea or on another body of water). The locking heads 302 can be in connection with the locking slide 306 and the pin 308 when in the locked position. One or more alignment padeyes 310 can also be connected onto the accompanying base wings 320 or the base surface 318, as depicted in FIG. 4. The alignment padeyes 310 can be welded, fastened (e.g., bolts, rivets, or screws), or otherwise attached to the base wings 320 or the base surface 318. The alignment padeyes 310 can be used as an attachment point, docking point, or to further stabilize and/or align each pair of connectors 300 to each other. Though four alignment padeyes 310 are depicted in this embodiment, greater or fewer alignment padeyes 310 can be connected to the base wings 320 or the base surfaces 318.

Figure 5:
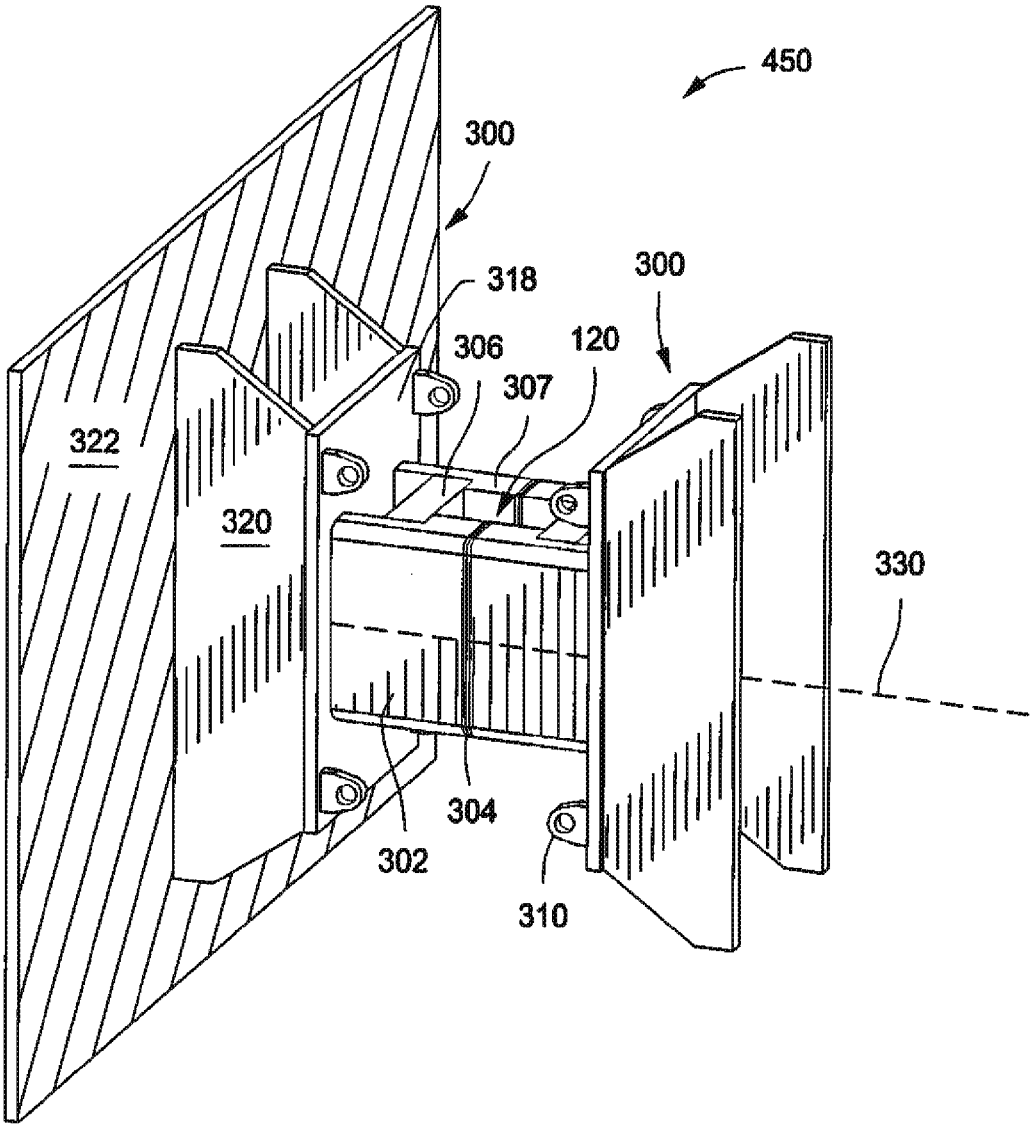
FIG. 5 depicts a perspective view of another illustrative coupled connector unit disposed in a vertical position, according to one or more embodiments described.

FIG. 5 depicts a perspective view of an illustrative coupled connector unit 450 disposed in a vertical position, according to one or more embodiments. The coupled connector unit 450 can include two connectors 300 vertically positioned and coupled together via the locking pin 120. Each of the connectors 300 can be oriented vertical or substantially vertical relative to the centralized axis 330 extending lengthwise through the center of the pin 308 contained in the coupled connector unit 450. The front surface 307 of the locking head 302 and the opening to the slot 312 can be facing vertical or substantially vertical relative to the centralized axis 330. The base wings 320 can be affixed or otherwise attached to the connecting surface 322 to secure the connectors 300 in the vertical position.

In one or more embodiments, a plurality of coupled connector units 150 (as depicted in FIGS. 1 and 2) can include a plurality of coupled connector units 350 and a plurality of coupled connector units 450 such that each coupled connector unit 350 can be adjacent to a coupled connector unit 450. For example, the connectors 300 can be aligned in multiple rows and columns across each connecting surface 322. In one embodiment, one connector 150 can be arranged so the first slots 312 can be positioned at an angle of about 45 degrees to about 135 degrees relative to the slots 312 of the next connector 150. In some examples, one connector 150 can be arranged so that the first slots 312 can be positioned at an angle of about 65 degrees to about 115 degrees, an angle of about 75 degrees to about 105 degrees, or about 85 degrees to about 95 degrees. In one example, pairs of coupled connector unit 350 and coupled connector unit 450 can be sequentially disposed next to each other on the connecting surface 322. The pairs of coupled connector unit 350 and coupled connector unit 450 can be arranged such that the coupled connector unit 350 are 90 degrees from the coupled connector unit 450.

The connecting surface 322 can be or include any portion of the first side 142 of the forward module 102, the first side 144 of the rear module 106, the first side 114 of the cargo module section 112, and/or the second side 116 of the cargo module section 112, as depicted in FIG. 1. Similarly, the connecting surface 322 can be or include any portion of the first side 242 of the cargo module 104, the first side 244 of the cargo module 104, the first side 214 of the cargo module 104, and/or the second side 216 of the cargo module 104, as depicted in FIG. 2. In other embodiments, the plurality of coupled connector units 150 (depicted in FIGS. 1 and 2) can include a first group of coupled connector units 350 (depicted in FIG. 4) disposed facing in a first direction and a second group of coupled connector units 450 (depicted in FIG. 5) disposed facing in a second direction different than the first direction.

In one or more embodiments, each of the coupled connector units 150, 350, and 450 can have a yield strength of about 200 MPa, about 250 MPa, about 300 MPa, or about 320 MPa to about 360 MPa, about 400 MPa, about 500 MPa, or about 600 MPa, based on the American Bureau of Shipping Rules for Building and Classing Steel Vessels 2013. For example, each of the coupled connector units 150, 350, and 450 can have a yield strength of about 200 MPa to about 600 MPa, about 200 MPa to about 500 MPa, about 300 MPa to about 600 MPa, about 300 MPa to about 500 MPa, about 300 MPa to about 400 MPa, about 320 MPa to about 400 MPa, about 320 MPa to about 390 MPa, about 330 MPa to about 380 MPa, about 340 MPa to about 370 MPa, or about 350 MPa to about 360 MPa, based on the American Bureau of Shipping Rules for Building and Classing Steel Vessels 2013.

In one or more embodiments, a first arrangement of the connectors 300 can include a first coupled connector unit 350 disposed adjacent (e.g., about 90°) or substantially adjacent relative to a first coupled connector unit 450. The first coupled connector unit 450 disposed adjacent or substantially adjacent relative to a second coupled connector unit 350. The second coupled connector unit 350 disposed adjacent or substantially adjacent relative to a second coupled connector unit 450. This first arrangement of the connectors 300 can be repeated as many times as desired to provide the pluralities of coupled connector units 350 and 450.

In other embodiments, a second arrangement of the connectors 300 can include a first coupled connector unit 450 disposed adjacent or substantially adjacent relative to a first coupled connector unit 350. The first coupled connector unit 350 can be disposed adjacent or substantially adjacent relative to a second coupled connector unit 450. The second coupled connector unit 450 can be disposed adjacent or substantially adjacent relative to a second coupled connector unit 350. This second arrangement of the connectors 300 can be repeated as many times as desired to provide the pluralities of coupled connector units 350 and 450.

In other embodiments, a third arrangement of the connectors 300 can include a first coupled connector unit 350 disposed adjacent or substantially adjacent relative to a second coupled connector unit 350. The second coupled connector unit 350 can be disposed adjacent or substantially adjacent relative to a first coupled connector unit 450. A first coupled connector unit 450 can be disposed adjacent or substantially adjacent relative to a second coupled connector unit 450. This third arrangement of the connectors 300 can be repeated as many times as desired to provide the pluralities of coupled connector units 350 and 450.

In other embodiments, a fourth arrangement of the connectors 300 can include a first coupled connector unit 450 disposed adjacent or substantially adjacent relative to a second coupled connector unit 450. The second coupled connector unit 450 can be disposed adjacent or substantially adjacent relative to a first coupled connector unit 350. A first coupled connector unit 350 can be disposed adjacent or substantially adjacent relative to a second coupled connector unit 350. This fourth arrangement of the connectors 300 can be repeated as many times as desired to provide the pluralities of coupled connector units 350 and 450.

The embodiments discussed above can be fully or partially included in the modular FPSO vessel 100 or 200. It is to be noted that the above arrangements disclose only some of arrangements of connectors 300 and should not be considered limiting to the claimed invention. For example, additional cargo modules 104 can be inserted, introduced, or otherwise added to provide larger storage capacities as required by the size of operation. Upon completion of the first job, the modular FPSO vessel 200 can be decommissioned. The modular FPSO vessel 200 can include the cargo module section 112 that can be increased or decreased relative to the specified production worksite. To accomplish this, the modular FPSO vessel 200 can be moved with assistance from a drydock. The drydock can be flooded and sunk to provide the modular FPSO vessel 200 to float on the open water. The modular FPSO vessel 200 can then be towed, moved, or otherwise relocated to a suitable location for modification. The cargo module section 112 can be modified at the most suitable modular breaks as determined by design parameters. The cargo module section 112 can be taken apart, removed, and modified to change the number of cargo modules 104 on the modular FPSO vessel 200.

The cargo module section 112 can include 1, 2, or 3 cargo modules 104 to 4, 5, 6, 8, about 10, about 12, about 15, about 20, about 25, or about 30 cargo modules 104. In some examples, the cargo module section 112 can include 1 to about 30, 1 to about 20, 2 to about 12, 2 to about 10, 2 to 8, 2 to 6, 2 to 4, 3 to about 12, 3 to about 10, 3 to 8, 3 to 6, or 3 to 4 cargo modules 104.

In one embodiment, the cargo module section 112 can include a single cargo module 204 which can be disposed between the forward module 102 and the rear module 106. The single cargo module 204 can be inserted, fastened, or otherwise connected to the forward module 102 and the rear module 106 by the plurality of connectors 300.

In another embodiment, the cargo module section 112 can include two cargo modules 104. The cargo modules 104 can be inserted, fastened, or otherwise connected to each other by a plurality of connectors 300. The cargo module section 112 can be disposed between the forward module 102 and the rear module 106 by the plurality of connectors 300.

In yet another embodiment, the cargo module section 112 can include three cargo modules 104. The cargo modules 104 can be inserted, fastened, or otherwise connected to each other by a plurality of connectors 300. The cargo module section 112 can be disposed between the forward module 102 and the rear module 106 by the plurality of connectors 300.

In yet another embodiment, the cargo module section 112 can include four cargo modules 104. The cargo modules 104 can be inserted, fastened, or otherwise connected to each other by a plurality of connectors 300. The cargo module section 112 can be disposed between the forward module 102 and the rear module 106 by the plurality of connectors 300. In some examples, the four cargo modules 104 can be aligned in a single row. In other examples, the four cargo modules 104 can be aligned in two rows containing two cargo modules 104. In the latter arrangement, each of the cargo modules 104 can have the connecting surface 322 include another plurality of connectors 300 disposed thereon.

In yet another embodiment, the cargo module section 112 can include five cargo modules 104. The cargo modules 104 can be inserted, fastened, or otherwise connected to each other by a plurality of connectors 300. The cargo module section 112 can be disposed between the forward module 102 and the rear module 106 by the plurality of connectors 300.

In yet another embodiment, the cargo module section 112 can include six cargo modules 104. The cargo modules 104 can be inserted, fastened, or otherwise connected to each other by a plurality of connectors 300. The cargo module section 112 can be disposed between the forward module 102 and the rear module 106 by the plurality of connectors 300. In some examples, the six cargo modules 104 can be aligned in a single row. In other examples, the six cargo modules 104 can be aligned in two rows containing three cargo modules 104 or three rows containing two cargo modules 104. In the latter two arrangements, each of the cargo modules 104 can have the connecting surface 322 include another plurality of connectors 300 disposed thereon.

In yet another embodiment, the cargo module section 112 can include seven cargo modules 104. The cargo modules 104 can be inserted, fastened, or otherwise connected to each other by a plurality of the connectors 300. The cargo module section 112 can be disposed between the forward module 102 and the rear module 106 by the plurality of connectors 300.

In yet another embodiment, the cargo module section 112 can include eight cargo modules 104. The cargo modules 104 can be inserted, fastened, or otherwise connected to each other by a plurality of connectors 300. The cargo module section 112 can be disposed between the forward module 102 and the rear module 106 by the plurality of connectors 300. In some examples, the eight cargo modules 104 can be aligned in a single row. In other examples, the eight cargo modules 104 can be aligned in two rows containing four cargo modules 104 or two rows containing four cargo modules 104. In the latter two arrangements, each of the cargo modules 104 can have the connecting surface 322 include another plurality of connectors 300 disposed thereon.

In yet another embodiment, the cargo module section 112 can include nine cargo modules 104. The cargo modules 104 can be inserted, fastened, or otherwise connected to each other by a plurality of connectors 300. The cargo module section 112 can be disposed between the forward module 102 and the rear module 106 by the plurality of connectors 300.

In yet another embodiment, the cargo module section 112 can include ten cargo modules 104. The cargo modules 104 can be inserted, fastened, or otherwise connected to each other by a plurality of connectors 300 and disposed between the forward module 102 and the rear module 106. In some examples, the ten cargo modules 104 can be aligned in a single row. In other examples, the ten cargo modules 104 can be aligned in two rows containing five cargo modules 104. In the latter arrangement, each of the cargo modules 104 can have the connecting surface 322 include another plurality of connectors 300 disposed thereon.

Figure 6:
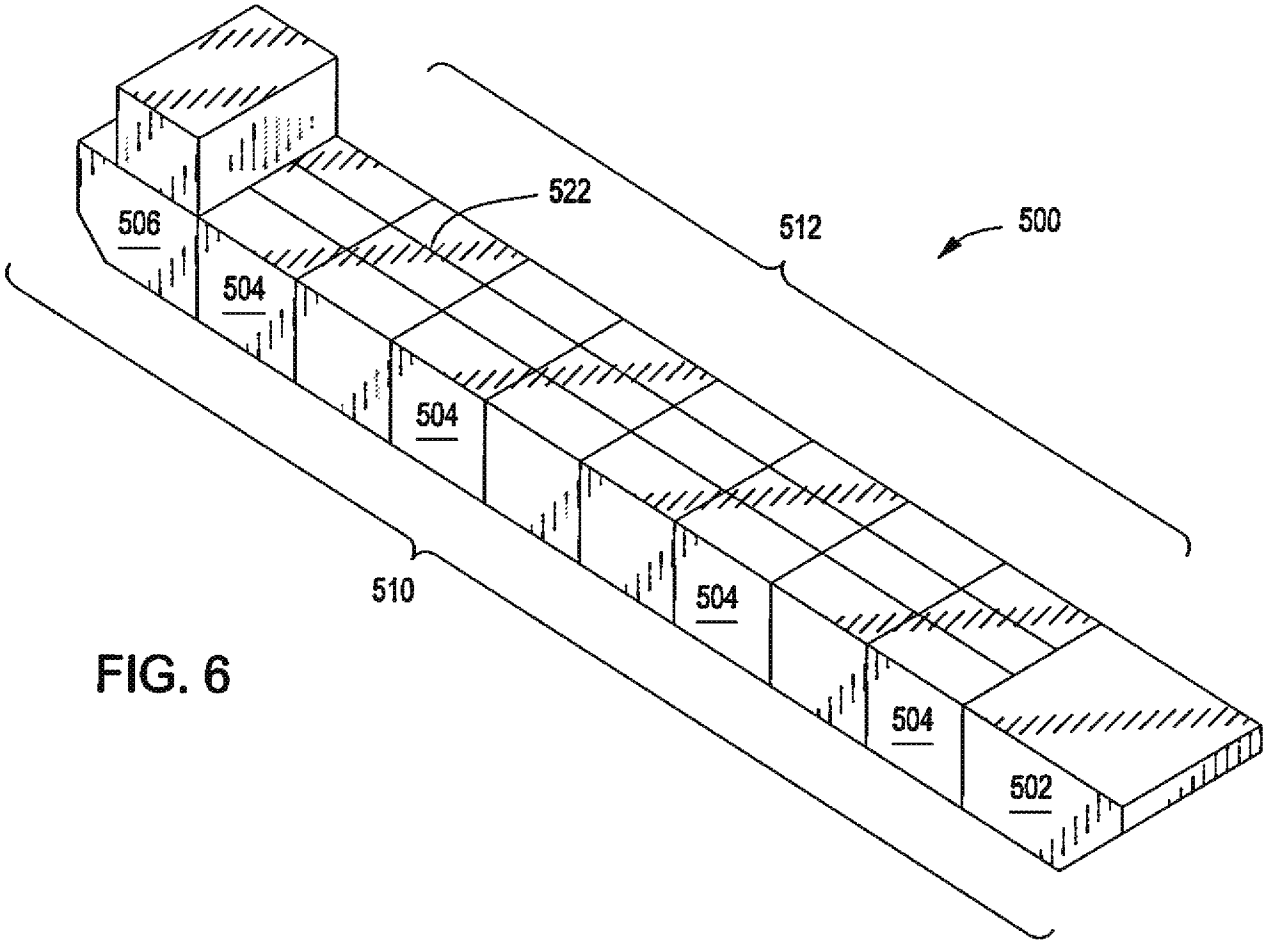
FIG. 6 depicts a perspective view of another illustrative modular floating production storage and offloading vessel, according to one or more embodiments described.

FIG. 6 depicts a perspective view of another illustrative modular FPSO vessel 500, according to one or more embodiments. In this configuration, the modular FPSO vessel 500 can include a forward module 502, one or more cargo modules 504, and a rear module 506. The cargo module section 512 can be inserted, fastened, or otherwise connected such that the cargo modules 504 can be arranged such that the cargo modules 504 can be aligned in two or more rows to form a larger cargo module section 512. For example, the cargo module section 512 can contain 24 cargo modules 504, such as, for example, three rows of cargo modules 504 wide and eight cargo modules 504 long, as depicted in FIG. 6. In one or more embodiments, each cargo module 504 can have one, two, three, or four sides that are connecting sides 522 that each can include a plurality of connectors. In one example, at least one of the sides of the cargo module 504 that is portside or starboard side can be one or more connecting sides 522. In this embodiment, the port sides and starboard sides of cargo modules 504 can be fastened, coupled, or otherwise connected through a plurality of connectors (not shown). Other connecting surfaces can be fastened, coupled, or otherwise connected to cargo modules 504 through another plurality of connectors (not shown).

Figure 7:
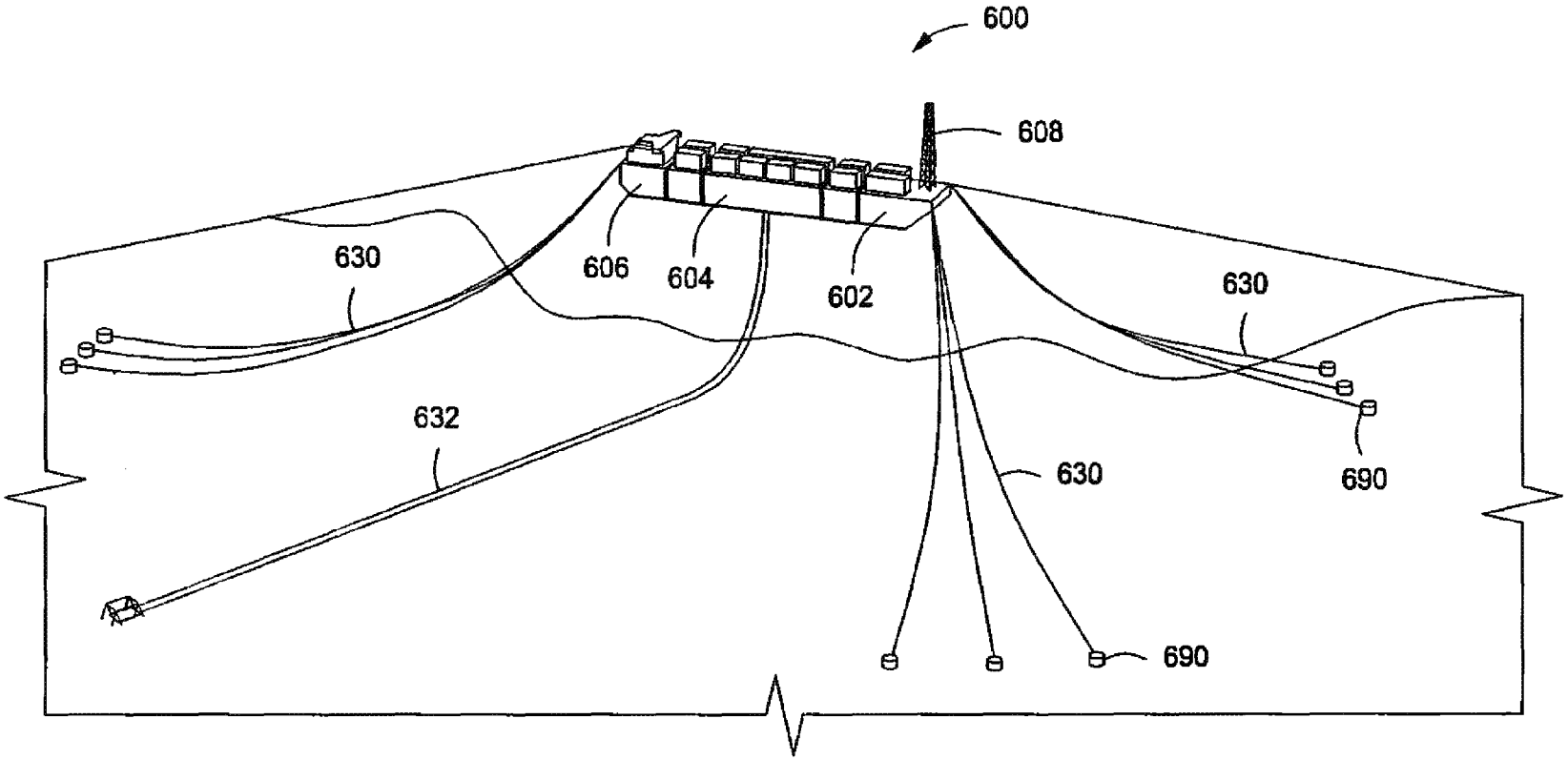
FIG. 7 depicts a perspective view of another illustrative modular floating production storage and offloading vessel that can be coupled to mooring lines and risers for offshore deployment, according to one or more embodiments described.

FIG. 7 depicts a perspective view of illustrative modular FPSO vessel 600 that can be coupled or otherwise connected to one or more mooring lines 630 and/or one or more risers 632 for offshore deployment, according to one or more embodiments. In this configuration, the modular FPSO vessel 600 can include a forward module 602, one or more cargo modules 604, and a rear module 606. A turret 608 can be disposed on the forward module 602, as depicted in FIG. 7. Alternatively, not shown, the turret 608 can be disposed on one of the cargo modules 604 or the rear module 606. Other production tools, not shown, can be disposed on any one or more of the forward module 602, one or more cargo modules 604, and/or the rear module 606. One or more mooring lines 630 and one or more risers 632 can be coupled or otherwise connected to the modular FPSO vessel 600. The mooring lines 630 can be connected to a well head 690. Other anchoring components, subsea systems, or other equipment can be disposed from the modular FPSO vessel 600. Mooring can be of the passive spread mooring, spread mooring, or single point mooring types or turret based. Mooring components can include chain, wire, rope, anchors, piles, connectors, bending shoes, fairleads, and other components. The mooring lines 630 can include studded or studless chains, wire rope, or synthetic rope.

The overall mooring system of the modular FPSO vessel 600 can be configured according to any of the FPSO vessel classifications listed in Table 1. In one embodiment, the mooring system can include four mooring groups and three mooring lines. In another embodiment, the mooring system can include of four mooring groups and four mooring lines 630. The top chain and the bottom chain of the various FPSO vessels can be vary in size of about 110 mm to about 137 mm. The bottom chain of the various FPSO vessels can be longer than the top chain in each configuration. The mid rope polyester of the various FPSO vessels can vary in size of about 195 mm to about 243 mm. In some embodiments, the minimum breaking load of the mooring system designs can be about 10,500 kN to about 16,000 kN depending on the type of FPSO. The modular FPSO vessel 600 can have a turret 608 in the in the forward module 602. Other configurations or designs of the modular FPSO vessel 600 can include the turret 608 or the production tool (not shown) in the rear module 606. In other embodiments, any of the modular FPSO vessels 100, 200, 500, or 600 can include mooring systems configured according to any of the FPSO vessel classifications listed in Table 1.

TABLE 1

Mooring system designs for different classes of modular FPSO vessels

| Property | Aframax | Suezmax | VLCC |
|---|---|---|---|
| Top Chain (length/size) | 126 m/110 mm | 126 m/137 mm | 126 m/136 mm |
| Mid Rope Polyester (length/size) | 2,218 m/195 mm | 2,218 m/243 mm | 2,218 m/240 mm |
| Bottom Chain (length/size) | 176 m/110 mm | 176 m/137 mm | 176 m/137 mm |
| Mooring System Configuration | 4 groups × 3 lines | 4 groups × 3 lines | 4 groups × 4 lines |
| Pre-tension (kN) | 1,575 | 2,400 | 2,355 |
| MBL (kN) | 10,500 | 16,000 | 15,700 |

In one or more embodiments, a modular FPSO vessel, such as any of the modular FPSO vessels 100, 200, 500, or 600, can be an Aframax class FPSO vessel, can be with or without a turret, and can have a cargo module section that can include one cargo module to five cargo modules, two cargo modules to four cargo modules, or three cargo modules. In other embodiments, a modular FPSO vessel, such as any of the modular FPSO vessels 100, 200, 500, or 600, can be a Suezmax class FPSO vessel, can be with or without a turret, and can have a cargo module section that can include three cargo modules to seven cargo modules, four cargo modules to six cargo modules, or five cargo modules. In other embodiments, a modular FPSO vessel, such as any of the modular FPSO vessels 100, 200, 500, or 600, can be a VLCC class FPSO vessel, can be with or without a turret, and can have a cargo module section that can include six cargo modules to twelve cargo modules, seven cargo modules to ten cargo modules, seven cargo modules to nine cargo modules, or eight cargo modules.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the invention, other and further embodiments of the invention can be devised without departing from the basic scope thereof, and the scope thereof is determined by the claims that follow.

What is claimed is:

1. A method for assembling a modular floating production storage and offloading vessel, the method comprising:

positioning a forward module, a rear module, and a cargo module section comprising one or more cargo modules disposed between the forward module and the rear module;

coupling at least one connector disposed on a side of the forward module to at least one connector disposed on a side of at least one module of the cargo section; wherein each connector comprises:

a base surface, a locking head disposed on the base surface, the locking head having slot configured therein, and a damper disposed on a surface of the locking head opposite of the base surface; and wherein the coupling comprises:

forcing the locking head of the connector of the forward module against the locking head of the connector of the module of the cargo section so that the slots of the two connectors are aligned; and inserting a locking pin into the aligned slots so that the dampers of the two connectors form a seal.

2. The method of claim 1, wherein an upper side of the forward module and an upper side of the cargo module are adjacent to each other and are connected to each other to form a continuous surface.

3. The method of claim 1, wherein the cargo module section comprises two cargo modules to about twelve cargo modules.

4. The method of claim 1, further comprising:

identifying a location in the cargo module section to receive an additional cargo module;

uncoupling cargo modules within in the cargo module section;

adding a module to the cargo module section; and coupling the added module to a cargo module in the cargo module section.

5. The method of claim 1, wherein the damper comprises a polymeric material.

6. The method of claim 1, further comprising installing a first topside module on an upper side of the forward module, wherein the first topside module comprises a flare tower, a turret, hydrocarbon production equipment, or any combination thereof.

7. The method of claim 6, wherein the topside module comprises the hydrocarbon production equipment, and wherein a crude oil is separated in the hydrocarbon production equipment to produce one or more of gaseous hydrocarbon products, liquid hydrocarbon products, or aqueous products.

8. A modular floating production storage and offloading (FPSO) vessel, comprising:

a plurality of modules comprising:

a forward module;

a rear module; and one or more cargo modules disposed within a cargo module section disposed between the forward module and the rear module and comprising one or more cargo modules; wherein adjacent modules are coupled together with connectors disposed on sides of each of the adjacent modules, each connector comprising:

a base surface, a locking head disposed on the base surface, the locking head having configured therein, and a damper disposed on a surface of the locking head opposite of the base surface; and wherein the connectors are configured so that when the locking heads of connectors of adjacent modules are forced together the slots of the connectors align and accept a locking pin, the pin securing the connectors together so that the dampers of the two connectors form a seal.

9. The FPSO vessel of claim 8, further comprising a topside module disposed on an upper side of the cargo module section, wherein the second topside module comprises hydrocarbon processing equipment, a hydrocarbon storage tank, or a combination thereof.

10. The FPSO vessel of claim 8, wherein the cargo module section comprises two cargo modules to about twelve cargo modules.

* * * * *